United States Patent [19]

Borgen

[11] Patent Number: 4,940,297

[45] **Date of Patent: * Jul. 10, 1990**

[54] PRODUCT DISPLAY AND MARKETING DEVICE

[75] Inventor: Arden L. Borgen, Des Moines, Iowa

[73] Assignee: Margaret Platt Borgen, Des Moines, Iowa

[ * ] Notice: The portion of the term of this patent subsequent to Apr. 4, 2006 has been disclaimed.

[21] Appl. No.: 330,596

[22] Filed: Mar. 29, 1989

Related U.S. Application Data

[63] Continuation-in-part of Ser. No. 49,733, May 13, 1977, Pat. No. 4,818,043.

[51] Int. Cl.[5] ..... A47F 3/00

[52] U.S. Cl. ..... 312/138.1; 312/198/116

[58] Field of Search ..... 312/116, 138 R, 198, 312/214, 296, 329, 108; 49/371, 501, 386; 16/275, 224, 273

[56] References Cited

U.S. PATENT DOCUMENTS

| | | | |
|---|---|---|---|
| 1,444,223 | 2/1923 | Tuomi | 49/371 |
| 2,251,482 | 8/1941 | Curtiss, Jr. | 16/275 |
| 2,575,822 | 11/1951 | Lyon | 49/371 |
| 3,540,154 | 11/1970 | Claudio | 49/371 |
| 4,087,139 | 5/1978 | Heaney | 312/214 |
| 4,223,482 | 9/1980 | Barroero et al. | 312/138 R |
| 4,818,043 | 4/1989 | Borgen | 49/371 X |

FOREIGN PATENT DOCUMENTS

| | | | |
|---|---|---|---|
| 3301524 | 7/1984 | Fed. Rep. of Germany | 312/198 |
| 131991 | 9/1919 | United Kingdom | 49/371 |
| 2167543 | 5/1986 | United Kingdom | 312/116 |
| 2183706 | 6/1987 | United Kingdom | 49/501 |

*Primary Examiner*—Joseph Falk

*Attorney, Agent, or Firm*—Zarley, McKee, Thomte, Voorhees & Sease

[57] ABSTRACT

The product display device of the present invention comprises a cabinet frame having a front opening therein. Two or more doors are positioned in covering relation over the front opening so as to form an enclosed compartment within the cabinet frame. Each of the doors includes an upper edge, a lower edge, a latching edge, a hinge edge, a front face and a rear face. The doors are arranged in side-by-side relationship with one another with the hinge edge of one door being adjacent the latching edge of the other door. The hinge edges of the doors are hinged at their upper and lower ends to the cabinet frame. A stop member is attached to the hinge edge of the first door and includes a latch surface extending laterally from the hinge edge and being in facing relationship to the rear face of the latching edge of the other door. A seal is attached to the rear face of the second door and sealingly engages the latch surface of the stop member of the first door to form a seal therebetween. A magnetic latch is associated with the seal for detachably securing the latching edge of the second door to the hinge edge of the first door. A modified form of the invention includes a door frame which is attached over the door opening of a walk-in cooler. The doors are mounted to this door frame.

8 Claims, 6 Drawing Sheets

PRODUCT DISPLAY AND MARKETING DEVICE

BACKGROUND OF THE INVENTION

This is a continuation-in-part of Application Ser. No. 049,733, filed May 13, 1977 now U.S. Pat. No. 4,818,043.

This invention relates to a product display and marketing device, and particularly to a display and marketing device for displaying and marketing refrigerated or frozen products such as refrigerated foods, floral products, frozen foods and the like.

Presently known display devices for refrigerated or frozen products generally include a plurality of doors which are openable at the front of the display device. These doors are opened often by customers, and therefore must be durable while at the same time being capable of easy opening and easy closing.

Presently existing doors for these display devices include rigid metal frames completely surrounding insulated glass panes. These metal frames fit within a corresponding metal frame in the cabinet itself. Thus, a plurality of vertical support members must be provided in the cabinet frame itself for accommodating the various doors therein.

While the aforementioned present structure provides reasonably good sealing around the doors, it does not present an attractive appearance from the exterior, since the rectangular frames of the doors and the rectangular frames for receiving the doors are visible to the customers. Furthermore, these rectangular frames interfere with the viewing by the customer of the merchandise within the cabinet. If the merchandise is positioned behind the rectangular frames of the doors, it is not readily visible by the customer.

Another disadvantage of present metal frame doors is that the metal frame is conductive of heat. Furthermore, the metal frame doors and the door frames for receiving the doors are subject to condensation and usually require anticondensation heaters to be placed therein. All this adds substantially to the refrigeration load necessary to maintain the device at the desired temperature.

Therefore, a primary object of the present invention is the provision of an improved product display device for refrigerated or frozen foods, flowers or other similar products requiring refrigeration.

A further object of the present invention is the provision of a display device having a plurality of glass doors which do not obstruct the view by the customer of the contents within the cabinet.

A further object of the present invention is the provision of a product display device which eliminates the necessity for vertical support frames adjacent the edges of the doors.

A further object of the present invention is the provision of a refrigerated product display device wherein the doors are made primarily of glass and do not include cumbersome rectangular frames surrounding the glass and obstructing the customer's view of the contents of the cabinet.

A further object of the present invention is the provision of a door assembly that can be mounted over the opening of a walk-in cooler and which provides the appearance of a wall of glass doors.

A further object of the present invention is the provision of a product display device which is attractive in appearance, effective in marketing, efficient in operation, and durable in construction.

SUMMARY OF THE INVENTION

The present invention utilizes a product display cabinet having a large front opening therein for accommodating a plurality of glass doors in side-by-side relation. The glass doors are capable of latching against one another, and therefore do not require vertical members on the cabinet frame for receiving each of the doors.

Each door comprises a glass panel assembly having a large rectangular exterior sheet of glass formed of tempered glass. Attached to the interior surface of the exterior glass are one or more laminated glass members which are spaced apart and which are similar in size than the exterior glass sheet member. Because of this difference in size, the outer glass sheet member includes a rearwardly facing outer margin which extends beyond the outer margins of the interior glass sheet members.

Each door includes a vertical hinge edge and a vertical latching edge opposite the hinge edge. The hinge edge is hinged at its upper and lower ends to the cabinet frame for pivotal movement about a vertical axis. The doors are arranged with the latching edge of each door adjacent the hinge edge of an adjacent door.

Extending along the hinge edge of each door is a vertical stop member which includes a latch surface extending outwardly beyond the hinge edge of the door. This latching surface is adapted to be positioned in facing relationship to the rear face of the latching edge of the adjacent door. An elastomeric seal extends around three sides of each door, and includes a magnetic latch thereon. The magnetic latch is adapted to retentively engage the latch surface of the vertical stop member and in combination with the seal provides an elastomeric seal therewith.

The aforementioned structure does not require any vertical members within the door opening of the cabinet. Each door is supported by the glass sheet members rather than by a metal frame as in prior doors. The glass doors provide an attractive outer surface which is unobstructed by vertical support frames or door frames, and which provides a smooth continuous surface from one door to another. Each door can be separately opened and shut for access into the compartment. The use of unframed glass doors also eliminates the use of highly conductive material around the door and door opening thereby improving the efficiency of the unit.

A second modification of the present invention provides a wall of doors which may be mounted over the opening to an existing walk-in cooler. Walk-in coolers are often utilized in various merchandising applications. The cooler includes a rear door which permits entrance into the cooler for stocking the cooler. The front of the cooler includes a large opening having a plurality of glass doors thereover. The customers can open the doors and remove the merchandise from the cooler.

The second modification of the present invention utilizes a continuous stainless steel door frame which can be mounted over the opening to the walk-in cooler. After the frame is mounted over the opening, a plurality of doors such as described above are mounted to the continuous frame to provide a wall of doors. The wall of doors include a plurality of doors in side-by-side relation without any vertical members other than the doors. The front surfaces of the doors present a smooth continuous glass surface.

DETAILED DESCRIPTION OF THE PREFERRED EMBODIMENT

Figure 1:
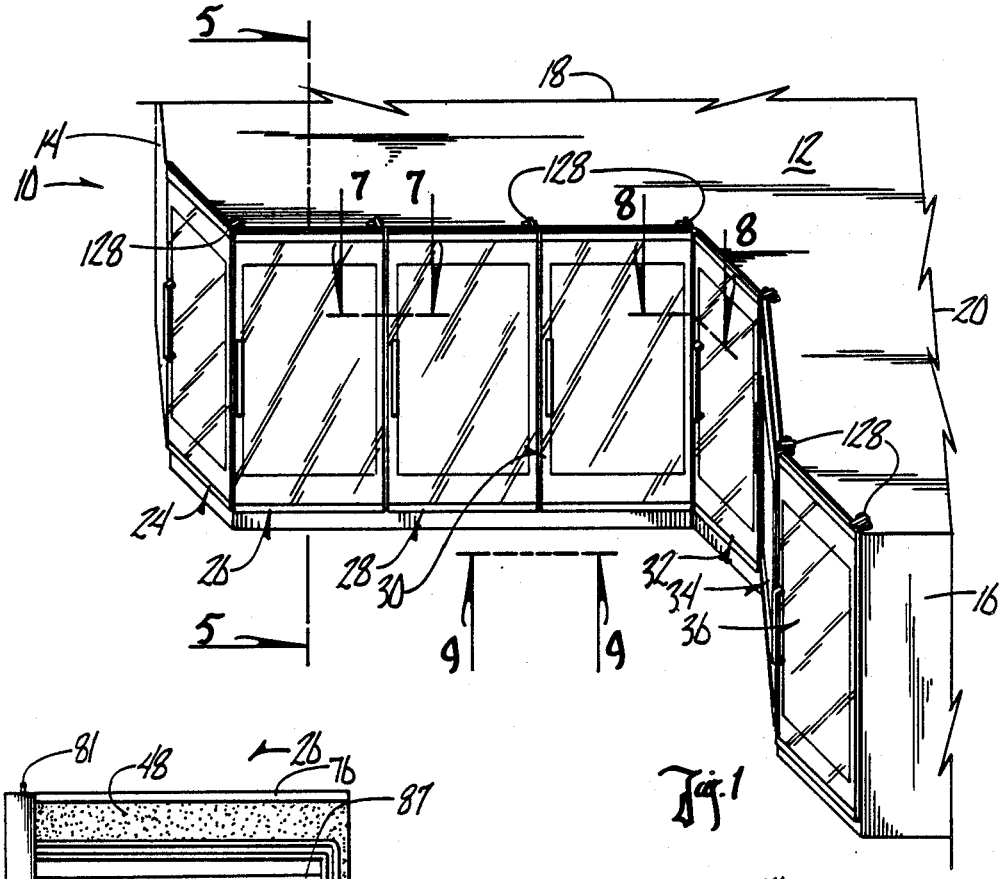
FIG. 1 is a perspective view of an irregularly shaped product display device of the present invention.
Figures 5, 6A, 6B:
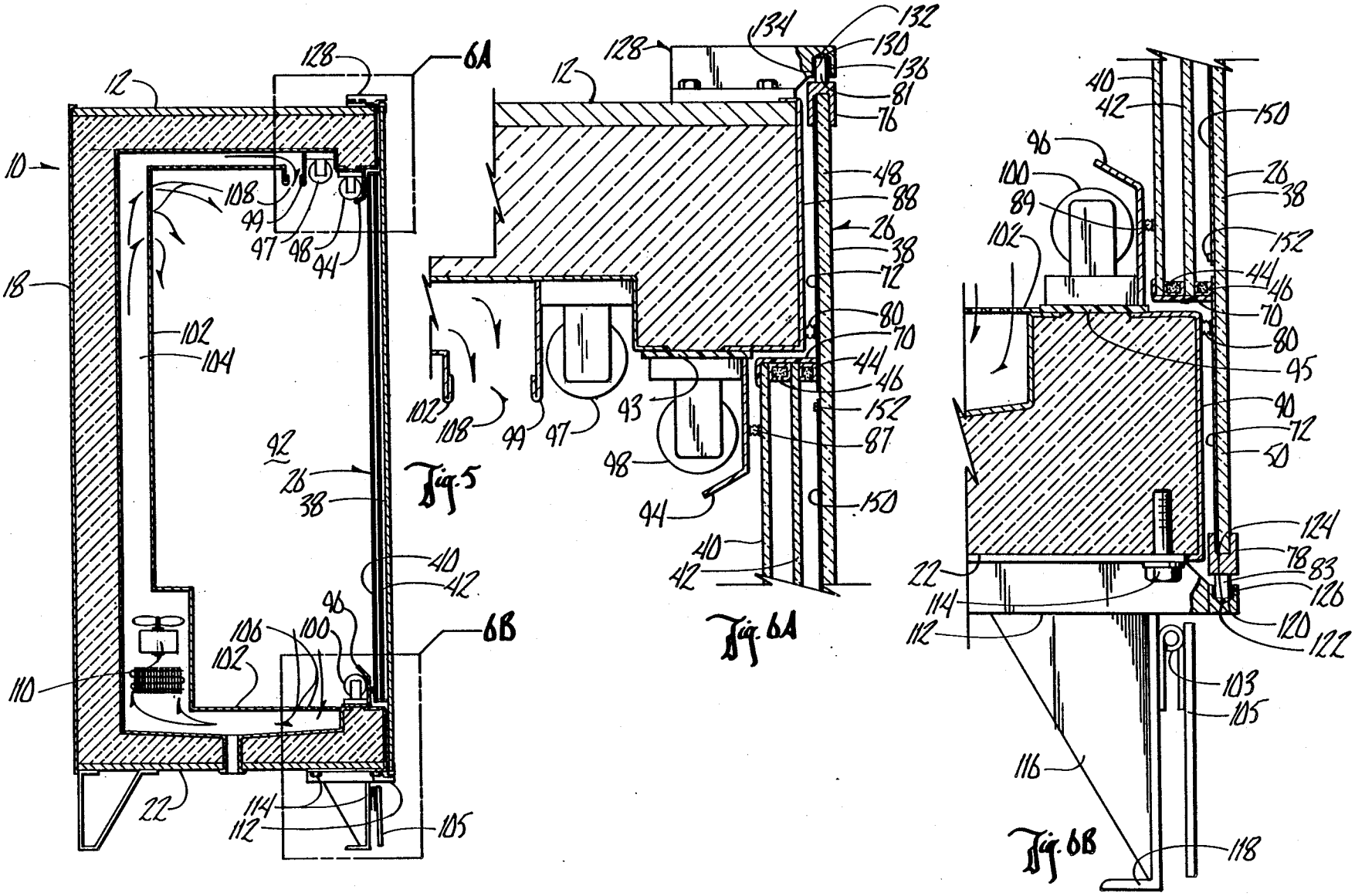
FIG. 5 is a sectional view taken along line 5—5 of FIG. 1.
FIGS. 6A and 6B are enlarged sectional views taken along lines 6A—6A and 6B—6B respectively, of FIG. 5.

Referring to the drawings, the numeral 10 generally refers to a product display device of the present invention. Device 10 comprises a display cabinet having a top wall 12, end walls 14, 16, rear walls 18, 20 and a bottom wall 22 (FIG. 5). Fitted over the front of device 10 in side-by-side relation are a plurality of doors 26, 28, 30, 32, 34 and 36. The number of doors may vary without detracting from the invention, but the doors shown in FIG. 1 illustrate the various irregular shapes which may be accommodated by the doors of the present invention. Presently known framed doors and openings do not permit this flexibility of design.

Figure 2:
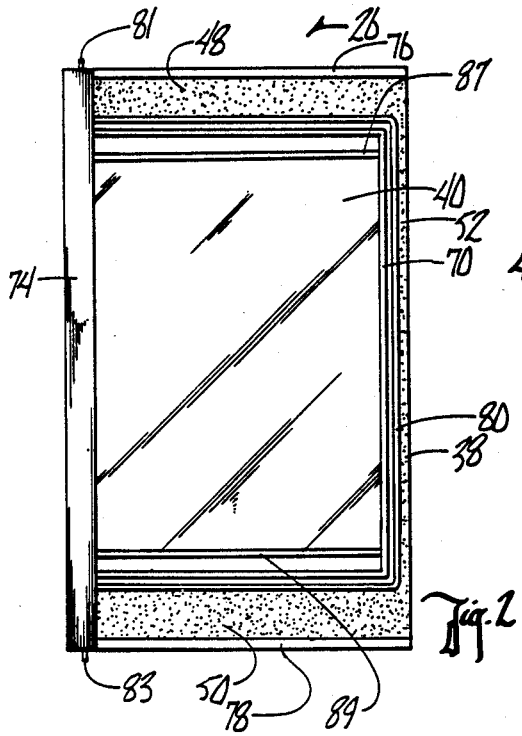
FIG. 2 is a rear elevational view of one of the doors of the present invention.
Figure 3:
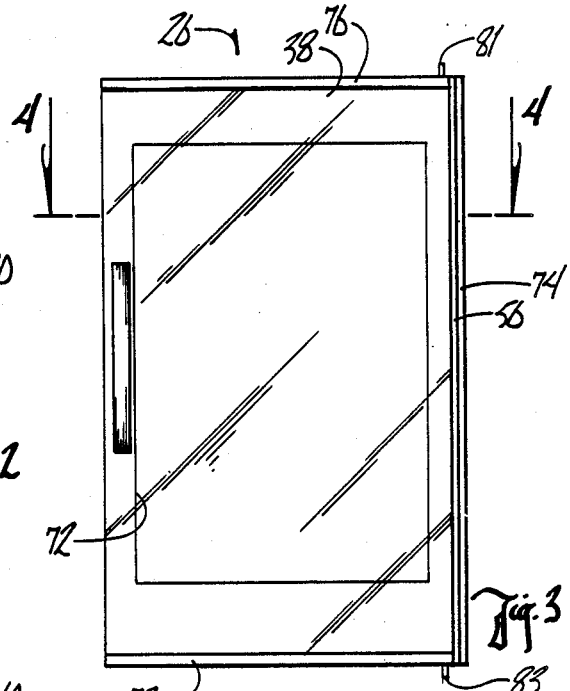
FIG. 3 is a front elevational view of one of the doors of the present invention.
Figure 4:
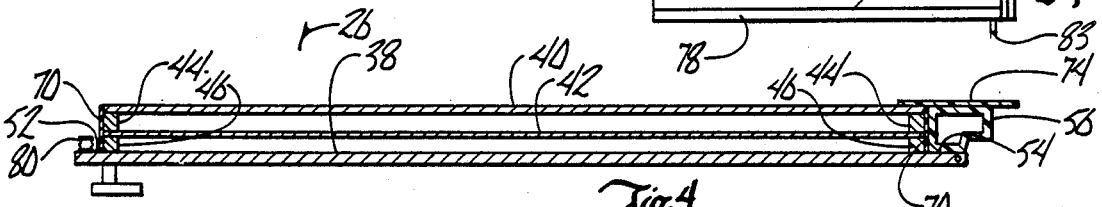
FIG. 4 is a sectional view taken along line 4—4 of FIG. 3.
Figure 7:
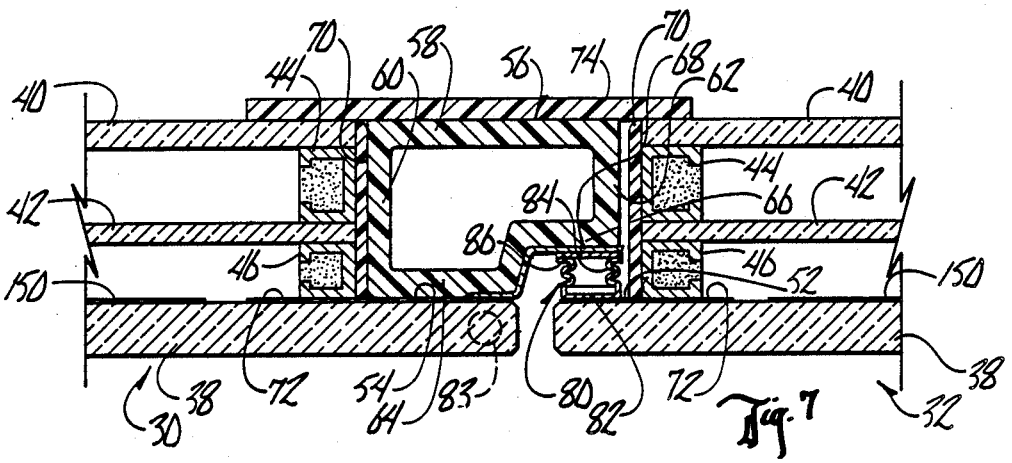
FIG. 7 is sectional view taken along line 7—7 of FIG. 1.

The general structure of a typical door 26 is illustrated by door 26 in FIGS. 2-4. Door 26 includes an outer rectangular tempered glass panel 38. Attached to the inner surface of panel 38 are a pair of spaced apart glass panels 40, 42 which are held in spaced apart relation to one another and to panel 38 by seals 44, 46 which provide an insulated three pane construction. Panels 40 and 42 are smaller in length and width than panel 38, thereby exposing an upper edge margin 48, a lower margin 50, and opposite side margins 52, 54 which protrude beyond the outer perimeters of glass panels 40, 42. Operatively adhered by adhesive or other means to the side margin 54 is a vertical elongated stop member 56. Stop member 56 is preferably constructed of a rigid extruded plastic material. Stop member 56 is shown in detail in FIG. 7 and includes in cross-section a back wall 58, end walls 60, 62, a first front wall 64, and a stop surface 66. Covering stop surface 66 is a sheet of magnetic stainless steel 68, which while being stainless steel is capable of magnetically interacting with a magnet. As can be seen in FIG. 7, the edges of glass panels 40, 42 are covered with a protective plastic edging member 70. Also as can be seen in FIGS. 3 and 7, the perimeter of the interior surface of outer glass panel 38 is covered with an opaque coating 72 which covers up the seals 44, 46 and the extruded stop member 56 from view from the exterior of door 26. Coating 72 may be a paint, a fired ceramic coating, a mirror, or other suitable coating.

Extruded stop member 56 is fitted within the L-shape provided by edging member 70 and opaque coating 72, and is adhered in that position to door 26 so that the extruded member 56 is fixed to door 26. A plastic backing plate 74 is adhered to the surface 58 of extruded member 56 and as can be seen in FIG. 7, backing plate 74 extends outwardly from the opposite sides of extruded member 58.

Referring again to FIGS. 2-4, the door 26 includes a protective metal rail 76 attached to the upper edge of outer glass panel 38 and a metal rail 78 attached to the lower edge of outer glass panel 38. As can be seen in FIGS. 6A and 6B, the rails 76, 78 are U-shaped in cross-section and include upper and lower hinge pins 81, 83 adjacent the stop member 56.

The primary support structure for door 26 is the tempered outer glass panel 38 which is substantially thicker than the glass panels 40, 42 and which provides the basic structural integrity for the door. This is to be contrasted with prior doors which rely upon a rectangular metal frame for providing the structural integrity of the door. The present door does not require such a frame, and is a frameless door. The rails 76, 78 do not have as their principal function the provision of structural support to the door, but instead are used to provide a means for mounting the hinge pins 81, 83 and also for protecting the lower and upper edges of the tempered glass panel 38.

Extending around the rearwardly facing margins 48, 50, 52 of outer glass panel 38 is an elongated sealing member 80 which is shown in cross-section in FIG. 7. Sealing member 80 comprises a backing strip 82 which is adhered or otherwise attached to the rearwardly facing margins 48, 50, 52 of outer glass panel 38. An elastomeric accordian-like central portion 84 is adapted to collapse toward and away from outer panel 38, and includes a magnetic strip 86 which is adapted to fit into retentive engagement with the magnetic stainless steel 68 on stop surface 66. Thus, as door 38 swings into facing engagement with stop member 56, the sealing member 80 moves into engagement with the stainless steel 68 on stop surface 66 and provides a latching engagement therewith. The sealing member 80 also engages a similar stainless steel strip 88 (FIG. 6A) attached to the forward edge of top wall 12 and engages a stainless steel strip 90 (FIG. 6B) on the forward edge of bottom wall 22 so as to provide a complete sealing engagement of doors 26, 28 and thereby provide a satisfactory enclosure for the compartment 92 within the device 10.

As can be seen in FIG. 2, a secondary upper seal 87 similar in cross-section to seal 80 is provided across the upper margin of glass panel 40 and a similar secondary lower seal 89 is provided across lower margin of glass panel 40. These secondary seals 87, 89 engage the stainless steel of light reflectors 94, 96 respectively as is shown in FIGS. 6A and 6B.

Referring to FIGS. 5 and 6, the top wall 12, the back wall 18, and the bottom wall 22 form a C-shaped construction in cross-section. The front edges of top wall 12 and bottom wall 22 are covered with the stainless steel sheeting 88, 90, respectively. Stainless steel sheeting 88 extends within the compartment 92 and terminates above a heat insulative gasket 93 which supports a light fixture 98. Light fixture 98 includes a stainless steel light shield 94. The front edge of bottom wall 22 includes a stainless steel cover 90 which extends within compartment 92 and terminates below a heat insulative gasket 95 which supports a light fixture 100. Light fixture 100 includes a stainless steel light shield 96. A third light fixture 97 is provided rearwardly and above light fixture 98 and includes a downwardly projecting light deflector 99 positioned rearwardly thereof. Light fixtures 97, 99 provide unique lighting to compartment 92. The deflector 94 deflects light rearwardly to the upper shelves within compartment 92, and the deflector 99 causes light to be directed toward the lower portion of compartment 92. This results in an eye pleasing even distribution of light within compartment 92 which is highly desirable for presenting the products within compartment 92 to the consumer. A lining 102 is provided on the interior of compartment 92 and provides an air passageway 104 along the bottom walls 22, the back wall 18 and the top wall 12. Lining 102 is provided with an air intake 106 and is also provided with a plurality of discharge openings 108 adjacent its upper end so as to permit the air to be taken into passageway 104 through intake 106 and to be directed upwardly by a fan 110 toward the upper end of the passageway 104 where the air is expelled through discharge holes 108 into the upper portion of the chamber or compartment 92. This provides a continuous circulation of air within the compartment 92 so as to minimize the formation of frost therein, and so as to provide uniform distribution of temperature therein. Deflector 99, in addition to providing desirable deflection of light from fixture 97 also protects fixture 97 from being directly exposed to the freshly refrigerated air exiting from discharge openings 108.

Rigidly attached to the bottom surface of bottom wall 22 is a hinge bracket 112 which is held in place by bolts 114. Bracket 112 includes a triangular gusseted leg 116 which has a foot 118 on its lower end. Bracket 112, gusseted leg 116 and foot 118 are of solid integral construction so that the bracket 112 is rigidly held in place by virtue of the weight of the device 110 resting upon foot 118. Bracket 112 includes a hinge pin cup 120 having a cone-shaped lower end 122 in which is received a ball bearing 124. The upper end of cup 120 includes a bushing 126. Hinge pin 83 of each door extends downwardly into bushing 126 and rests upon ball bearing 124. Attached to upper wall 12 is a similar hinge bracket 128 having a cup 130 with a pointed inner end 132 which receives a ball bearing 134. A bushing 136 is also provided in cup 130. Upper hinge pin 81 is inserted into cup 130 and rotates within bushing 136 and against ball bearing 132. It has been found that these hinges are very satisfactory for bearing the heavy load produced by the glass panel doors 24, 26, 28, 30, 32, 34 and 36. The rigid connection of the bottom hinge bracket 112 to the bottom wall 22 provides a stable base for the hinge pin 82. This is further enhanced by virtue of the fact that the bracket 112 is integral with the leg 116 and foot 118 and is rigidly attached to the under surface of bottom wall 22. The weight of the device 10 enhances the strength and stability of the cup 120 and the hinge provided by the insertion of pin 82 into cup 120. Furthermore, the ball bearing 124 and the upper ball bearing 132 provide a substantially reduced friction to the hinged movement of the doors.

Attached to foot 118 is a piano-type hinge 103 to which is attached a kick plate 105. Kick plate 105 is preferably in the form of a highly polished stainless steel or mirror surface. The hinge 103 permits kick plate 105 to be pivoted upwardly so as to permit cleaning beneath the device 10.

Figure 8:
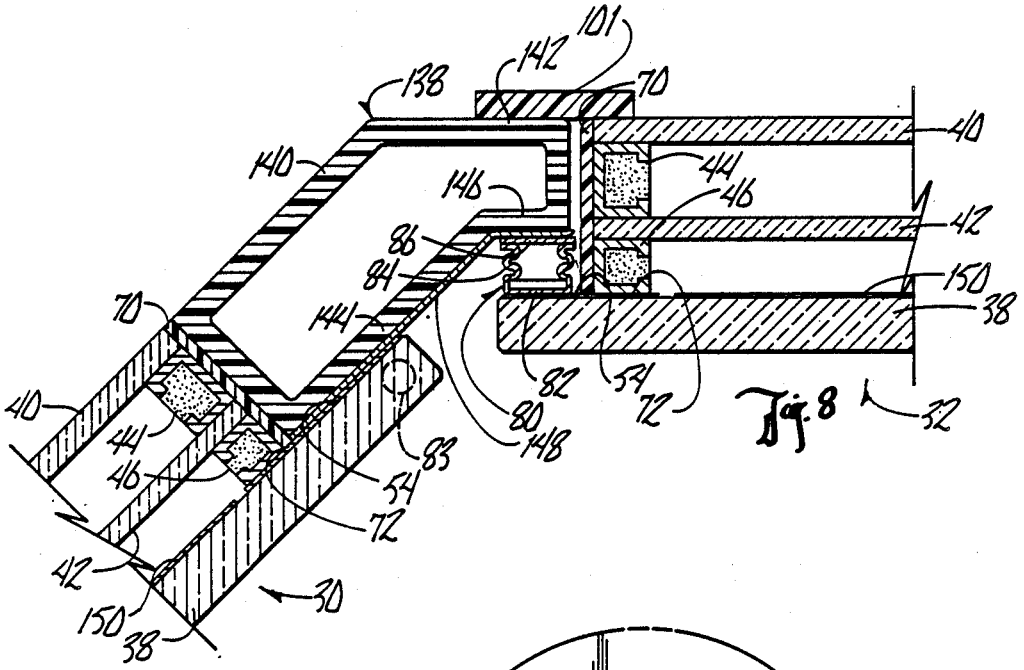
FIG. 8 is a sectional view taken along line 8—8 of FIG. 1.

FIG. 8 is a sectional view taken along line 8—8 of FIG. 1, and shows how the doors 30, 32 form a seal when the angle between the doors 30, 32 is less than 180°. This is accomplished by the utilization of a stop member 138 having a slightly different cross-sectional configuration from the stop member 56 shown in FIG. 7. Stop member 138 is provided with two rear walls 140, 142 which are angularly disposed with respect to one another, and with two front walls 144, 146. A magnetic stainless steel strip 148 is provided over surfaces 144, 146 and is angled at an angle which conforms to the angles of the two doors 30, 32. The magnet 86 of door 38 is adapted to engage the stainless steel 148 which covers surface 146 of stop member 138.

Other shapes of extruded members 138 can be used to provide varying angles of intersection between the various doors. The respective angles of the surfaces 144, 146 shown in FIG. 8 may be changed to accommodate any particular angle whether that angle be greater than or less than 180°. Thus, complete flexibility is possible in the shape and angles of the doors of various configurations, and the configuration shown in FIG. 1 illustrates these various angles which may be employed.

All four edges of each door are provided with thermal breaks which minimize the conduction of heat from outside the door to the interior of compartment 92. For example, the stainless steel sheet 88 (FIG. 6A) is separated from the stainless steel shield 94 by insulative gasket 93 so that heat cannot be conducted directly therebetween. Gasket 93 also acts as a barrier between sheet 88 and other metal components within compartment 92.

Similarly gasket 95 (FIG. 6B) acts as a barrier between stainless steel sheet 90 and shield 96, as well as other metal components within compartment 92. Secondary seals 87, 89 further facilitate the thermal break by preventing cold air from being directly exposed to stainless steel sheets 88, 90 respectively.

The thermal break for the vertical edges of the doors is illustrated in FIGS. 7 and 8. In FIG. 7, the stainless steel strip 68 terminates adjacent seal 80, thereby providing a thermal break which prevents heat from being conducted through strip 68 to the interior of compartment 92. The fact that stop member 56 and backing plate 74 are constructed of plastic further impedes conduction of heat into the interior of compartment 92.

In FIG. 8, a similar construction is shown. Stainless steel sheet 148 terminates adjacent seal 80, and the plastic construction of stop member 138 and backing plate 101 further contributes to providing a thermal break between the interior and exterior of compartment 92.

The interior surface of outer glass panel 38 may be provided with a transparent electrical conductor film 150 which includes an electrical connection 152 (FIGS. 6A and 6B) for connection to outside lead wires (not shown). Film 150 is capable of providing heat to the interior surface of outer panel 38 so as to minimize the formation of steam, frost or condensation on the surface of outer panel 38.

Figure 9:
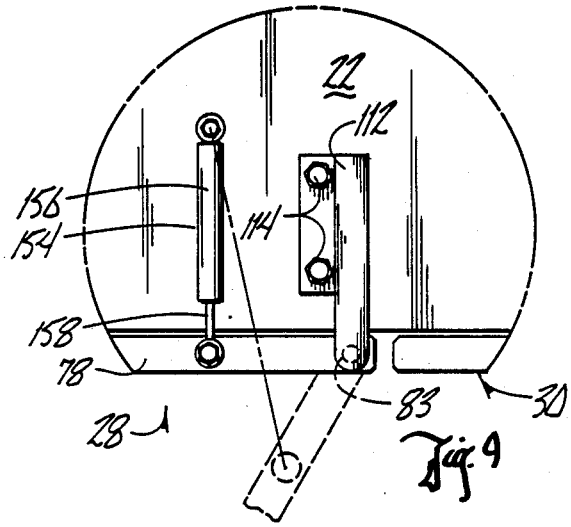
FIG. 9 is a bottom view taken along line 9—9 of FIG. 1.
Figure 10:
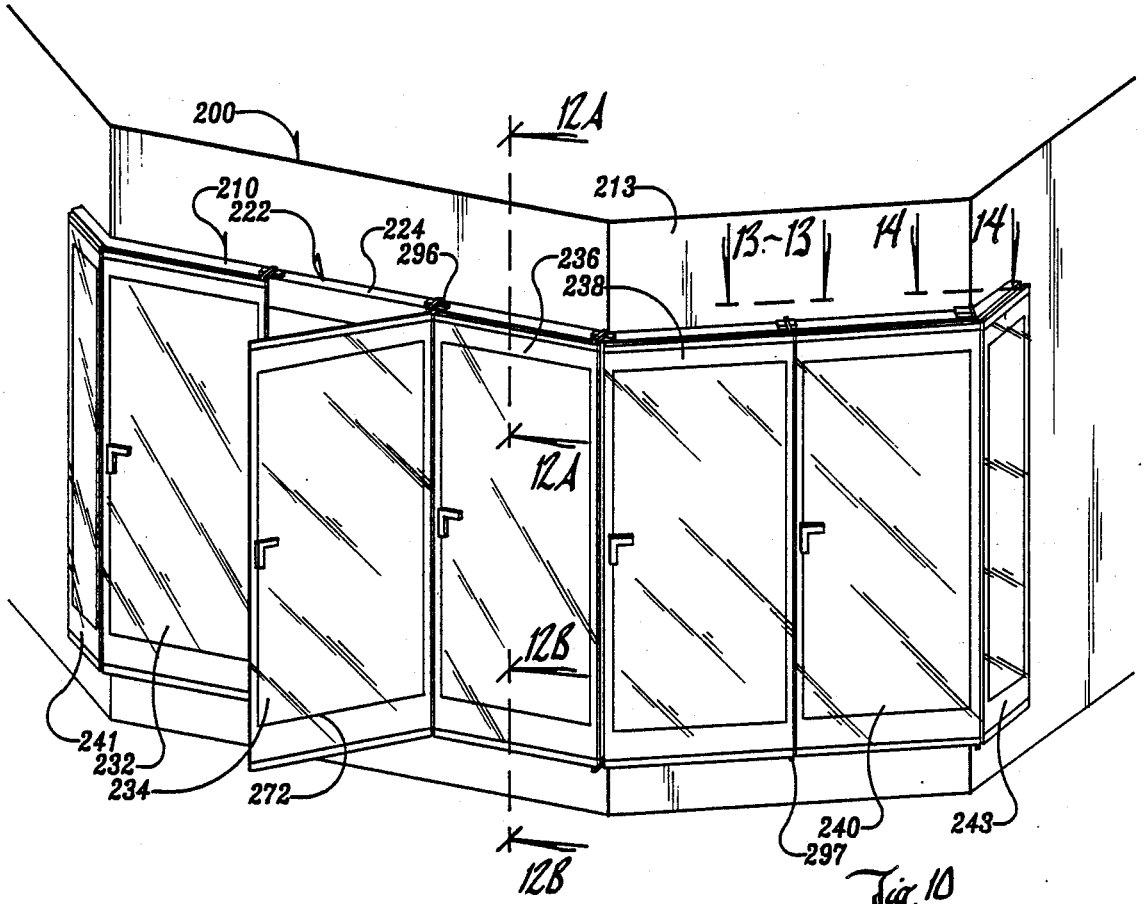
FIG. 10 is a perspective view of a modified form of the invention utilized in combination with a walk-in cooler.

Referring to FIG. 9, a closure member 154 is shown and includes a cylinder 156 and a spring loaded rod 158. The closer 154 is adapted to permit the door 126 to pivot outwardly to the position shown in shadow lines in FIG. 9 against the spring bias of the spring loaded rod 158. However, when the customer releases the door, the spring loaded rod 158 retracts within cylinder 156, thereby returning the door to its closed position.

Thus, it can be seen that the present invention provides a frameless glass door which presents an attractive outer appearance to the customer. Furthermore, the various doors are latched to one another rather than to a door frame or mullion post as in conventional devices, thereby making the products within the display case more visible to the customer.

The glass panels of the door provide the structure to the door as opposed to the use of metal frames containing thin glass plates in prior art devices. The hinge arrangement of the present door permits the weight of the door to be borne on a Nylon bushing in a cup having a ball bearing at the bottom thereof. The hinge pin rests on the ball bearing and provides a minimum of friction, while at the same time providing solid support for the hinge of the door.

The doors of the present invention may be placed at a plurality of angles with respect to one another so as to provide an infinite number of possibilities of design shapes and sizes for the cabinet.

Referring to FIGS. 10–14, a modified form of the door assembly is shown and is designated by the numeral 210. Door assembly 210 is adapted to be mounted over an irregular door opening 212 which is provided in a product display compartment 200. Display compartment 200 includes a compartment wall 213 in which the door opening 212 is provided. Door opening 212 includes an upper margin 214, opposite side margins 216, 218, and a bottom margin 220.

The door assembly includes a door frame 222 having a top frame member 224, opposite side frame members 226, 228, and a bottom frame member 230. Door frame 222 is made of stainless steel which is capable of receiving a magnetic seal. The door frame is constructed in a predetermined shape adapted to conform to the outer margins of door opening 212.

Figure 15:
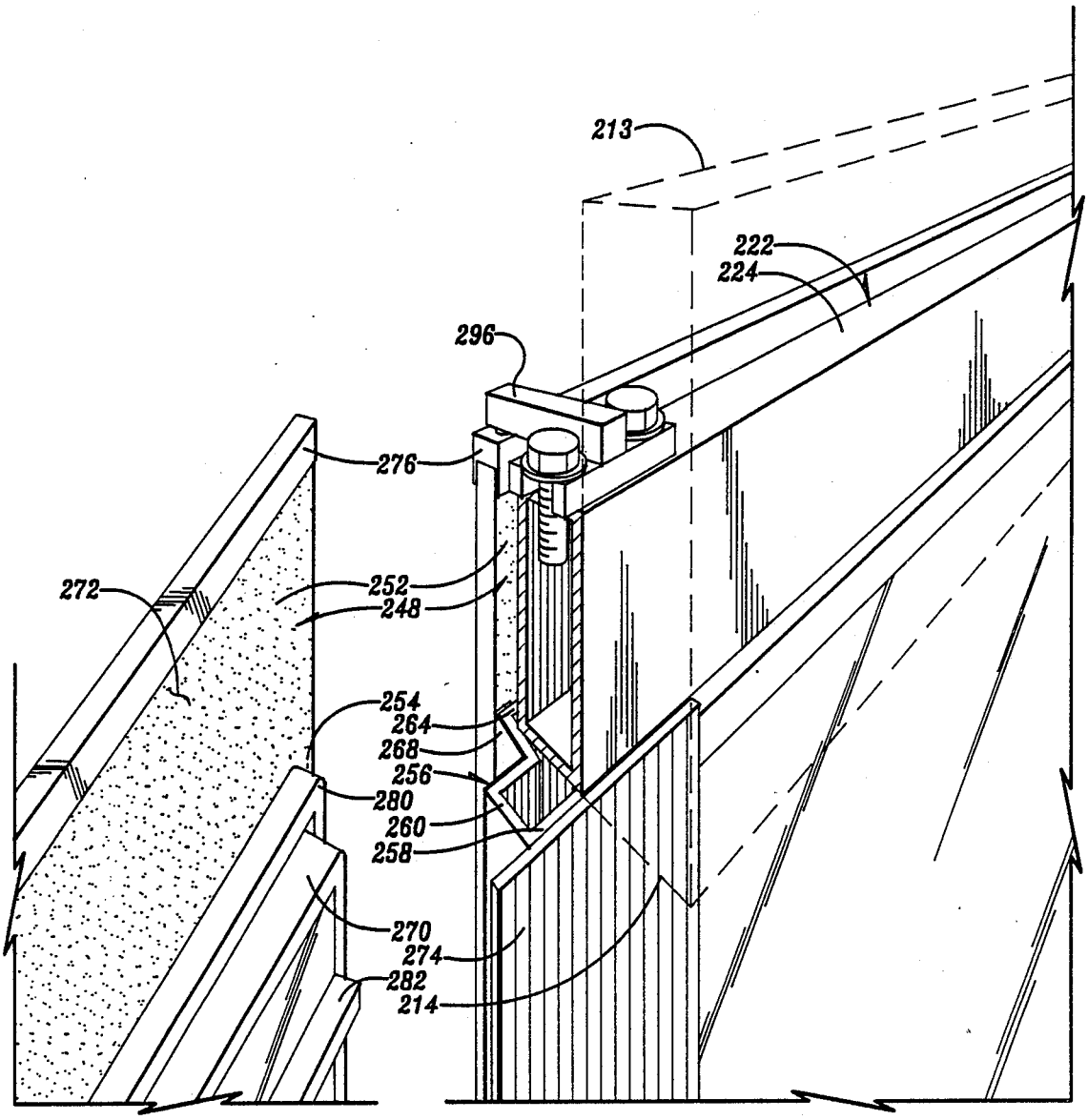
FIG. 15 is an enlarged detailed view shown partially in section of the upper edges of two adjacent doors.
Figure 17:
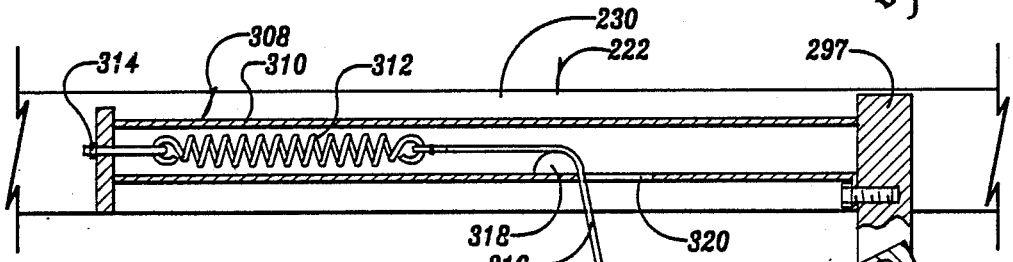
FIG. 17 sectional view taken along line 17—17 of FIG. 16.
Figure 17:
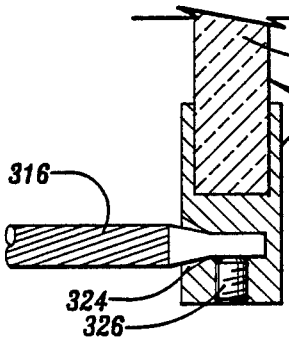
Figure 16:
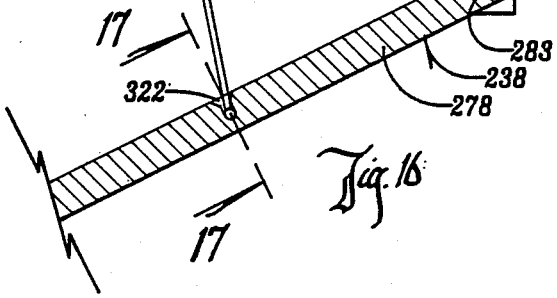
FIG. 16 sectional view as taken along line 16—16 of FIG. 11.

Mounted over the front of door frame 222 are a plurality of doors 232, 234, 236, 238, and 240. Also mounted are at the opposite ends of door frame 210 are a pair of fixed glass panels 241 and 243. Each door is similar in construction to door 26 shown in FIGS. 2–4, and includes an outer tempered glass panel 242, a middle glass panel 244, and an inner glass panel 246. Outer glass panel 242 includes a protruding upper edge margin 248 (FIG. 12A), a protruding lower margin 250 (FIG. 12B), and opposite side margins 252, 254 (FIG. 15). Adhered to the hinge edge of each door is an elongated stop member 256 similar to the stop member 56 shown in FIGS. 2–4. Stop member 256 includes a back wall 258, an end wall 260, a front wall 264, and a magnetic stainless steel covering 268. Each of the doors includes a protective plastic edging member 270 (FIG. 15) which provides protection to the edges of the inner glass panels 244, 246. An opaque paint or coating 272 is provided around the outer margins of the outer surface of tempered glass panel 242. A backing plate 274 (FIG. 15) is adhered to the interior surface of inner panel 246 in similar fashion to that shown for backing plate 74 shown in FIG. 4. Extending along the upper edge of tempered glass panel 242 is a metal rail 276 (FIG. 12A) and extending along the lower edge of glass panel 242 is a metal rail 278. Rails 276 and 278 are each provided with upper and lower hinge pins 281, 283 respectively.

Extending along upper edge margin 248, side margin 252, and lower edge margin 250 of glass panel 242 is a continuous outer sealing member 280. Extending across the upper edge and lower edge of interior glass panel 246 are a pair of horizontal sealing members 282.

Figure 12A:
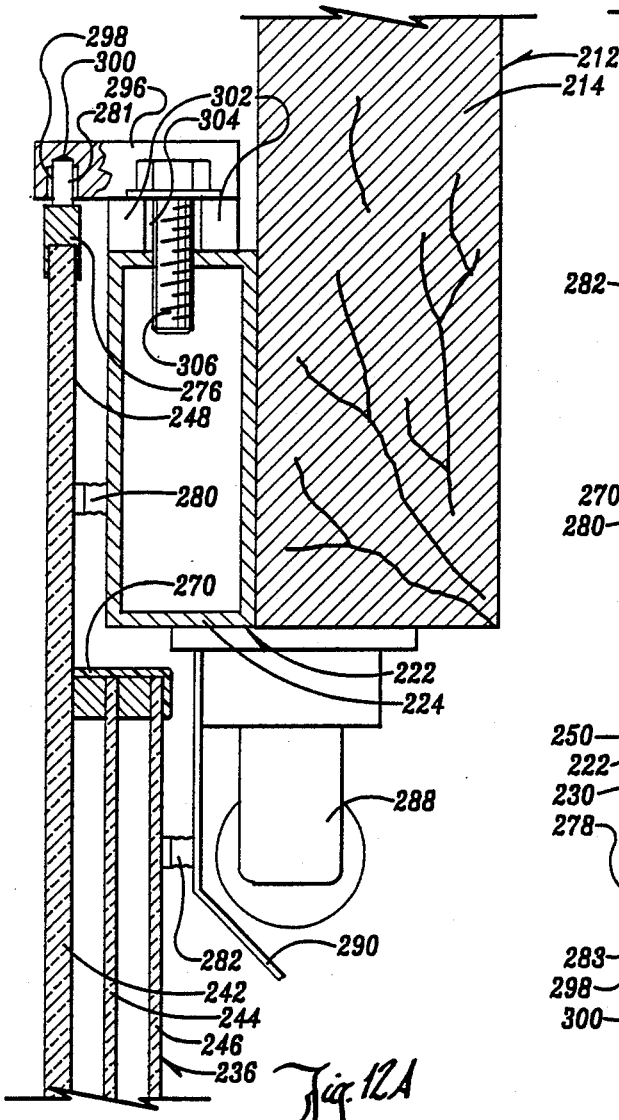
FIG. 12A is a sectional view taken along line 12A—12A of FIG. 10.
Figure 12B:
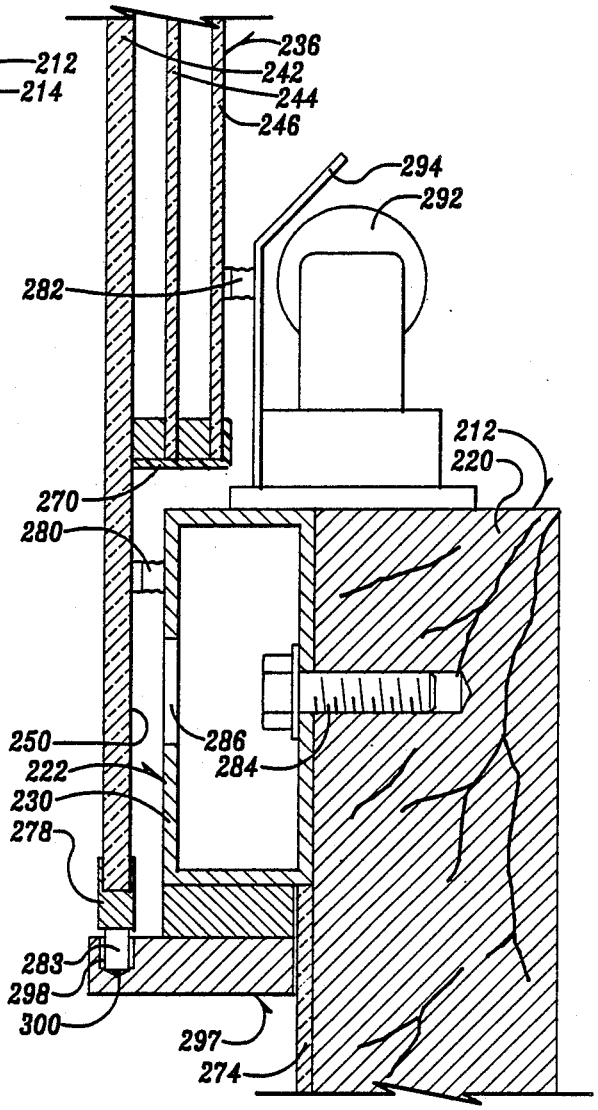
FIG. 12B is a sectional view taken along line 12B—12B of FIG. 10.

Door frame 222 is operatively attached to the exterior surface 213 of compartment 200 by any suitable means such as lag bolts 284 (FIG. 12B). An access opening 286 may be provided in the door frame 222 so as to permit access of wrenches or other tools to lag bolt 284. Mounted within the upper margin 214 of door opening 212 is an upper light fixture 288 having a magnetic upper stainless steel shield 290. Mounted adjacent the lower margin 220 of the door opening is a lower light fixture 292 having a magnetic stainless steel shield 294.

Figure 13:
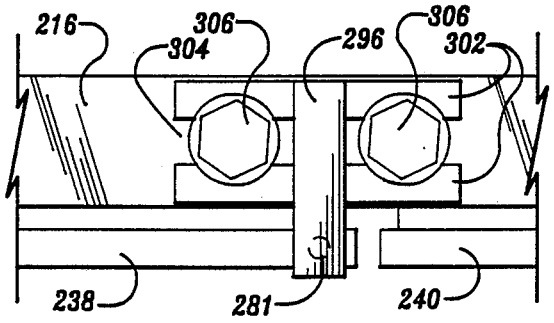
FIG. 13 is a top plan view taken along line 13—13 of FIG. 10.
Figure 14:
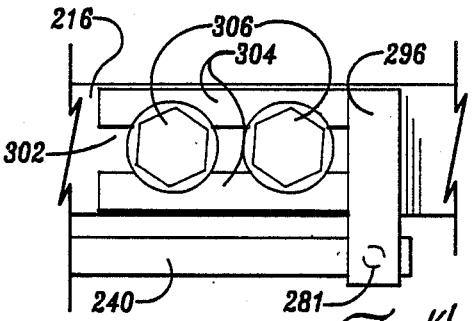
FIG. 14 is a top plan view taken along line 14—14 of FIG. 10.

The doors are mounted to the door frame 222 by means of upper and lower hinge brackets 296, 297 which are identical in construction. They each include a pin recess 298 for receiving the hinge pins 281, 283 of the door assemblies. A ball bearing 300 is provided at the extreme inner end of the pin recess 298. Hinge brackets 296 also include two spaced-apart cross bars having a slot 304 therebetween. A pair of adjustment bolts 306 extend downwardly through the slots and are threaded into the door frame 222 as shown in FIG. 12A, 13 and 14. The longitudinal slot 304 permits horizontal adjustment of the position of the hinge bracket 296 merely by the loosening of bolts 306, the repositioning of the bracket 296, and the retightening of bolts 306.

FIG. 14 shows a modified form of the bracket 296 which is utilized for the right-hand door 240. Bracket 296 is positioned at one end of the two spaced apart bars 302 rather than being centered with respect to those bars as shown in FIG. 13.

When the doors are mounted with hinge pins 281, 283 in the receptacles 298 of brackets 296, 297, they provide a sealing engagement in the manner shown in FIGS. 12A and 12B. Seal 280 seals against the stainless steel frame 222, and the horizontal seals 282 seal against the upper and lower light shields 290, 294.

Also, as shown in FIG. 15, the sealing member 280 engages the magnetic stainless steel member 268 mounted on stop member 256 to provide a continuous seal in the same manner as shown for the doors of FIGS. 1–9.

Figure 11:
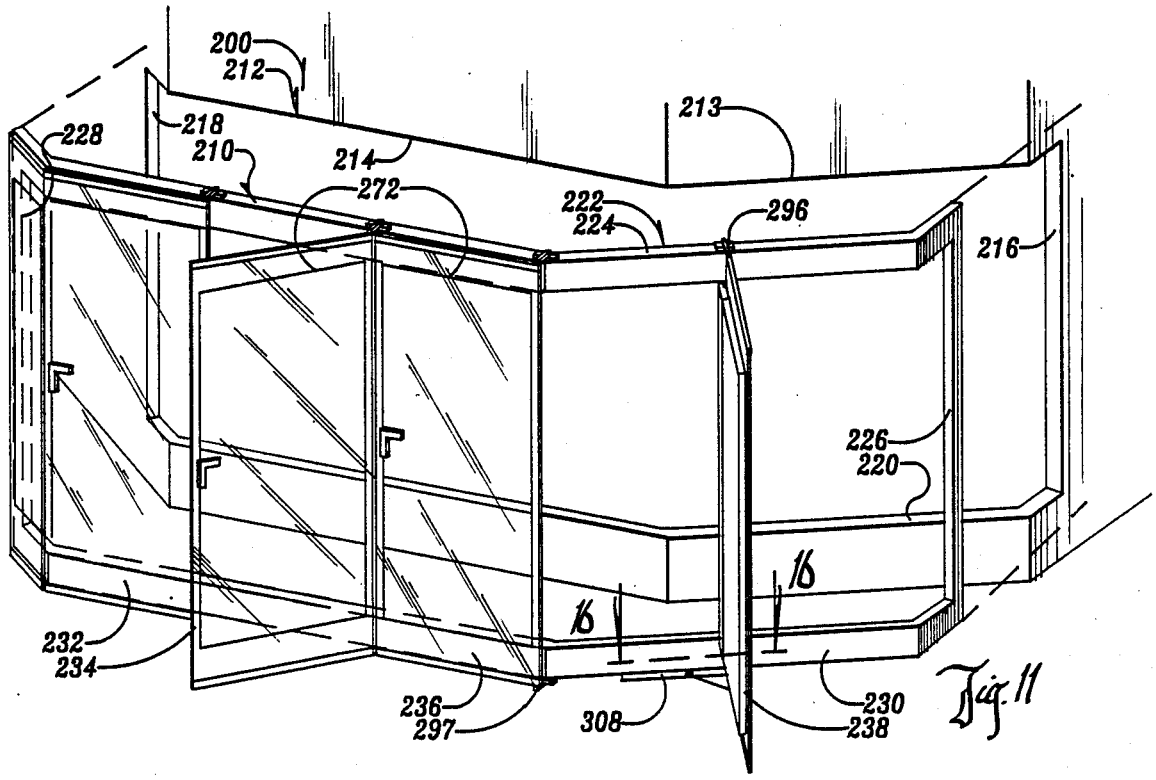
FIG. 11 is an exploded perspective view similar to FIG. 10.

The numeral 308 designates a door closer which can be used for each of the doors. Door closer 308 is mounted to the lower edge of door frame 222 as shown in FIG. 11. Closer 308 includes an elongated tube 310 having a spring 312 mounted therein by means of a bolt 314. Connected to spring 310 is a flexible cable 316 which extends over a cam 318 and outwardly through an opening 320. Cable 316 includes a distal end 322 which extends into an opening 324 in the lower metal rail 278 of the door where it is held in place by means of a set screw 326. Opening of the door causes the spring to be expanded, and the spring causes the door to close automatically when released.

The door assembly shown in FIGS. 10-16 is advantageous for use with a walk-in cooler which has a large door opening. The door frame 222 can be customed shape to fit the door opening. Once the door frame is attached over the door opening, it is possible to mount the doors by means of their hinge pins 281, 283 and by means of the mounting brackets 296, 297. When fully assembled, the doors provide a continuous outer surface which creates the visual impression of a wall of doors. There are no vertical members between the various doors other than the doors themselves, and the doors in combination present a smooth glass surface which is pleasing to the eye. Thus, it can be seen that the device accomplishes at least all of its stated objectives.

I claim:

1. A door assembly for a product display compartment having compartment wall provided with a door opening having an upper margin, opposite end margins, and a bottom margin, said assembly comprising:

a continuous door frame sized and shaped to conform generally to the size and shape of said door opening perimeter, said door frame being operatively attached to said compartment wall in registration with said perimeter of said door opening;

said door frame having an upper frame member, a lower frame member, and opposite end frame members defining a frame opening, each of said upper, lower, and end frame members having a flat front surface facing outwardly away from said display compartment;

a plurality of doors positioned in covering relation over said frame opening, each of said doors comprising a top edge in covering relation over said front face of said upper frame member, a bottom edge in covering relation over said lower frame member, a hinge edge, and a latching edge, said doors being made of glass and having a front planar surface facing outwardly away from said compartment, said doors being in edge to edge relation with said hinge edge of each door being closely adjacent said latching edge of an adjacent one of said doors;

sealing means between said latching edges and said hinge edges of adjacent ones of said doors for providing a thermal seal therebetween;

hinge means connecting each of said doors to said door frame for hinged movement between open and closed positions about a vertical hinge axis adjacent said hinge edge of each of said doors;

said frame opening being free from any vertical members extending between said upper and lower frame members other than said plurality of doors.

2. A door assembly according to claim 1 wherein said front planar surfaces of said plurality of doors provide in combination a continuous planar glass surface when said doors are all in said closed position.

3. A door assembly according to claim 1 wherein said hinge means comprise hinge bracket means connected to said door frame, and hinge pin means connected to said doors and pivotally retained in said hinge bracket means, said hinge bracket means being adjustably mounted to said door frame for permitting selective adjustment of the positions of said hinge means relative to said door frame.

4. A door assembly according to claim 1 wherein said sealing means on each of said doors comprise an elongated sealing member having an upper horizontal portion extending along said top edge of said door, a vertical portion extending along said latching edge of said door, and a bottom portion extending along said bottom edge of said door.

5. A door assembly according to claim 1 wherein each of said doors comprise at least an inner glass panel and an outer glass panel secured together in parallel spaced relation to one another, said outer glass panel being thicker than said inner panel and being constructed of tempered glass so as to be capable of providing primary structural support for said door.

6. A door assembly according to claim 5 wherein said door additionally comprises a middle glass panel positioned between said outer and inner panels.

7. A door assembly according to claim 6 wherein said inner and middle glass panels are smaller in dimension than said outer glass panel so as to expose a rearwardly facing perimetric margin of said outer glass panel.

8. A door assembly according to claim 7 wherein said sealing means extends around at least a portion of said rearwardly facing perimetric margins of said outer glass panel.

* * * * *